United States Patent [19]

Roy

[11] Patent Number: 4,609,114

[45] Date of Patent: Sep. 2, 1986

[54] SAFETY CLOSURE WITH NESTED CAPS

[75] Inventor: Gerald L. Roy, Lancaster, Pa.

[73] Assignee: Kerr Glass Manufacturing Corporation, Los Angeles, Calif.

[21] Appl. No.: 726,130

[22] Filed: Apr. 23, 1985

[51] Int. Cl.[4] ..... B65D 55/02

[52] U.S. Cl. ..... 215/220

[58] Field of Search ..... 215/219, 220

[56] References Cited

U.S. PATENT DOCUMENTS

| | | | |
|---|---|---|---|
| 2,964,207 | 12/1960 | Towns | 215/220 |
| 3,055,524 | 9/1962 | Glasbrenner | 215/220 |
| 3,472,411 | 3/1968 | Turner | 215/220 |
| 3,764,033 | 10/1973 | Smith et al. | 215/220 |
| 3,795,337 | 3/1974 | Nozawa | 215/220 |
| 3,795,338 | 3/1974 | Swartzbaugh et al. | 215/220 |
| 3,817,416 | 6/1974 | Costa | 215/220 |

*Primary Examiner*—George T. Hall

*Attorney, Agent, or Firm*—Fitch, Even, Tabin & Flannery

[57] ABSTRACT

A nested, two-piece, child-resistent closure is provided which includes an inner cap having a rigid, non-deformable upper end and a cylindrical skirt with a smooth outer surface and threaded inner surface. The outer upper end of the inner cap includes a series of upwardly projecting lugs arranged adjacent the center thereof. A series of upwardly projecting segments, of a height less than that of the lugs, is arranged about the periphery of the upper end of the inner cap. The outer cap, coaxially aligned with and generally overlapping the inner cap, has a resilient upper end and a cylindrical skirt with a smooth inner surface. Depending downwardly from the inner surface of the outer cap's upper end is a series of lugs aligned with the lugs on the inner cap to provide unidirectional drive means in the closure direction. The outer cap also has a series of downwardly projecting segments designed to engage the segments adjacent the periphery of the inner cap upon deformation of the edge of the outer cap, thus permitting rotation of the inner cap in the removal or unthreading direction.

7 Claims, 8 Drawing Figures

SAFETY CLOSURE WITH NESTED CAPS

The present invention relates generally to safety closures, and more particularly to a child-resistent closure having nested inner and outer caps related in a manner that requires manipulation beyond the ability of a small child to remove the closure from the container.

BACKGROUND OF THE INVENTION

The use of child-resistent closures on containers designed to store potentially dangerous substances has become commonplace, with closure designs having nested inner and outer caps being conventional. In such nested closures, the inner cap usually threads onto the container to provide the primary seal therewith. The inner cap is slightly spaced from the outer cap and, absent certain manipulations, the inner cap will not rotate in unison with the outer cap to effect a closure or open the container. Commonly, the adjacent faces of the depending skirts on the outer and inner caps are formed with inter-engageable projections which are cooperable to allow rotation of the inner cap in the thread-on direction after depressing the skirt of the outer cap to enmesh the projections. To remove the closure one had to compress inwardly the skirt walls of the outer cap to bring projections thereon into interacting engagement with projections on the skirt of the inner closure. Thus, both a radial skirt compression and a turning torque were required. While these types of nested safety closures, which are more fully disclosed in U.S. Pat. No. 3,926,328, have proven satisfactory for their intended purpose, the cooperable relationship of projections on the inner skirt wall of the outer cap and the outer skirt wall of the inner cap has required the precise tooling and molding of the diameters of the caps. Previous attempts to reduce the criticality of the diameter dimensions of the caps have resulted in closures in which inter-engagement of the intermeshing projections was not always certain, even by adults, resulting in a "stripping" action between the inner and outer closures, i.e., the outer cap would not function to rotate the inner cap.

SUMMARY OF THE INVENTION

Accordingly, it is the primary object of the present invention to provide a nested, two-piece, child-resistent closure in which the criticality required in tooling and molding the cap skirt walls is reduced.

Another object is to provide such a nested safety closure which still permits positive on-off action when manipulated by an adult.

A nested closure meeting these objects is provided in which the inner cap has a rigid, non-deformable upper end and a cylindrical skirt with a smooth outer surface and threaded inner surface. The outer, upper end of the inner cap includes a series of upwardly projecting lugs arranged adjacent the center thereof. A series of upwardly projecting segments, of a height less than that of the lugs, is arranged about the periphery of the upper end of the inner cap. The outer cap, coaxially aligned with and generally overlapping the inner cap, has a resilient upper end and a cylindrical skirt with a smooth inner surface. Depending downwardly from the inner surface of the outer cap's upper end is a series of lugs aligned with the lugs on the inner cap to provide unidirectional drive means in the closure direction. The outer cap also has a series of downwardly projecting segments designed to engage the segments adjacent the periphery of the inner cap upon deformation of the edge of the outer cap, thus permitting rotation of the inner cap in the removal or unthreading direction. The skirt walls may be free of interlocking elements to provide a one-way drive. Other features and advantages will become apparent upon reference to the following detailed description and accompanying drawings.

DETAILED DESCRIPTION OF THE PREFERRED EMBODIMENT

Figure 1:
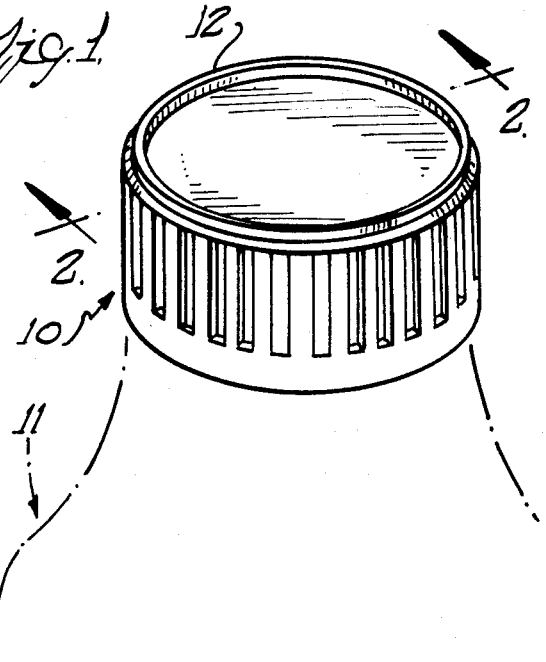
FIG. 1 is a perspective view illustrating a safety closure in accordance with the present invention, the safety closure being assembled on a container shown in phantom.

Turning now to the drawings, FIG. 1 shows a safety closure, indicated generally by 10, in accordance with the present invention and shown as being secured on a container, indicated in phantom at 11. The container 11 may be made of glass, metal or plastic, and includes an external right-hand thread thereon (not shown) adjacent its open upper end.

The safety closure 10 includes an outer cap 12, preferably made by injection molding of polypropylene or a similar material, and an inner cap 14 similarly manufactured and coaxially nested within the outer cap 12. The outer cap 12 has a resilient upper, flat, circular, closed end or top wall 15 and a depending annular skirt 16 formed integral therewith. The inner cap 14 includes a rigid, upper, flat, circular, closed end 18, and an integral depending annular skirt 19. The depending skirt 19 is provided with a threaded internal surface 20 for threading onto the external thread of the container 11.

To maintain the inner cap 14 and outer cap 12 in nested relation, the outer cap 14 has an annular lip or projection 21 extending radially inwardly from the inner surface of the annular skirt 16 so as to underlie the lower annular end of the skirt 19 of the inner cap 14. In this fashion, once nested, the inner cap 14 is captured or confined within the outer cap 12.

In keeping with the invention, unidirectional drive means, generally indicated by 22, is provided between the upper ends 18 and 15 of the inner and outer caps 14 and 12, respectively, for effecting the rotation of the inner cap 14 in the closure direction, but for slipping and being ineffectual when a torque is applied in the reverse removal direction. With a right-hand thread on the container 11, the unidirectional drive means 22 screws on the inner cap 14 by rotation of the outer cap 12 in the clockwise direction (when viewed from above), but allows the turning of the outer cap 12 in the counterclockwise direction without rotating the inner cap 14. (If the container 11 has a left-hand thread, the unidirectional drive means 22 will be oriented so that counterclockwise rotation of the outer cap 12 causes corresponding rotation of the inner cap 14 in the counterclockwise direction, while clockwise rotation of the outer cap 12 is ineffective to rotate the inner cap 14.)

The unidirectional drive means 22 includes a plurality of drive lugs 24 formed integrally with and depending downwardly from the lower surface of the upper flat end 15 of the outer cap 12. The lugs 24 are equidistantly spaced adjacent the center of the upper end 15, and each lug 24 includes a downwardly inclined ramp surface 25 which intersects a generally vertical planar drive surface 26. When the inner cap 14 is nested within the outer cap 12, the lower ends 28 of the lugs 24 rest upon the upper flat end 18 of the inner cap 14, and are selectively cooperable with a corresponding number of lugs 29 projecting upwardly from the upper end surface 18 of the inner cap 14. Thus, a depression of the outer cap by an automatic capping device into interlocking engagement with the inner cap allows the closure to be readily threaded onto the container by a conventional automatic capping device.

Figure 6:
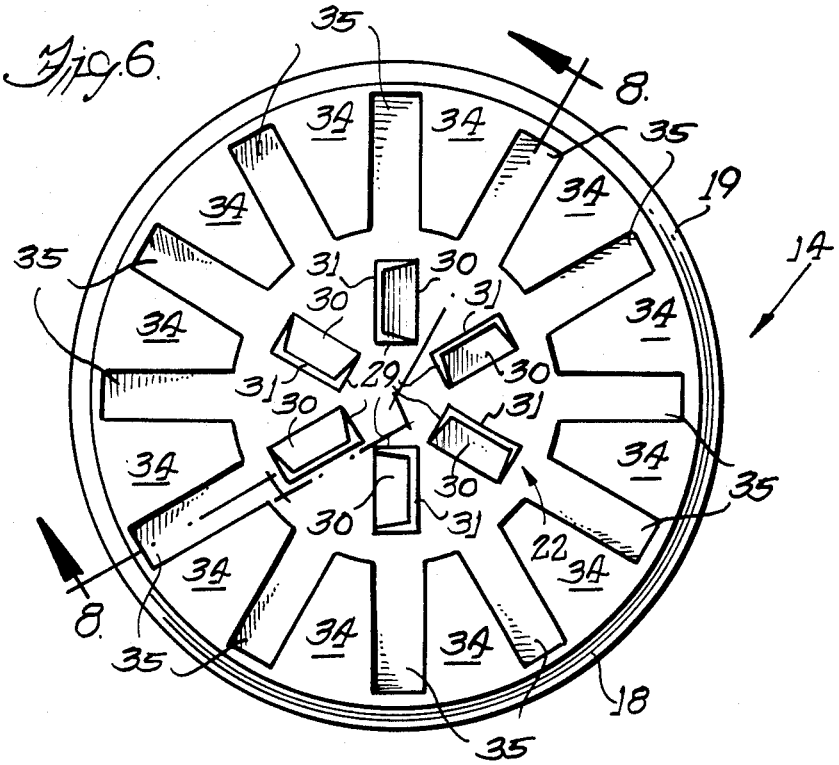
FIG. 6 is a plan view of the exterior of the inner cap.
Figure 7:
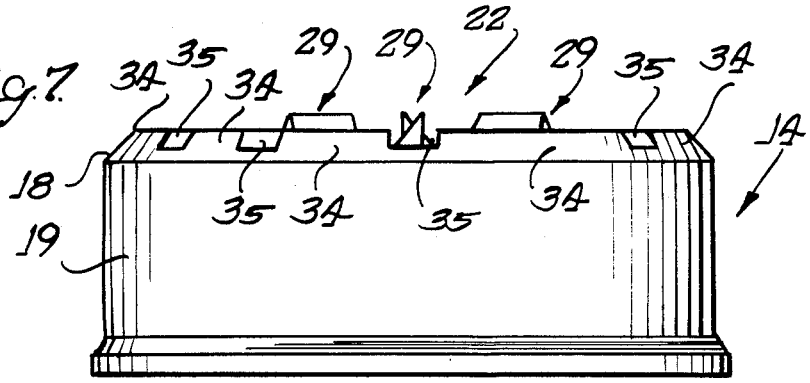
FIG. 7 is an elevational view of the inner cap.
Figure 8:
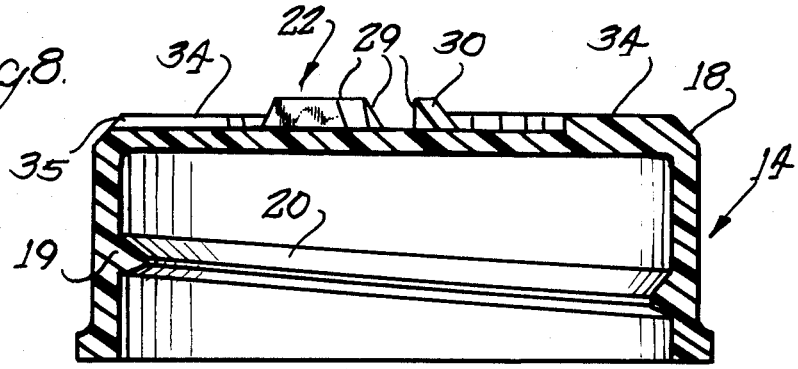
FIG. 8 is a cross-sectional elevation of the inner cap taken substantially along line 8—8 of FIG. 6.

As with the lugs 24, each lug 29 on the inner cap 14 includes an inclined ramp surface 30 (FIG. 6) which intersects a generally vertically disposed drive surface 31. The lugs 24 and the lugs 29 are adapted for cooperating face-to-face engagement through their drive faces 26 and 31, respectively, to effect rotation of the inner cap 14 when the outer cap 12 is rotated in a clockwise direction. However, if the outer cap 12 is rotated in a counterclockwise or removal direction, the inclined ramp surfaces 25, 30 have an insufficient frictional force to allow the outer cap 12 to rotate the inner cap 14. The top wall 15 of the outer cap 12 merely flexs upward at the central portion thereof without unscrewing the inner cap 14, as the lugs 24 on the outer cap 12 override the lugs 29 on the inner cap 14.

In keeping with the invention, drive surfaces are provided on the peripheral areas of the outer surface of the upper end 18 of the inner cap 14 and the inner surface of the resilient upper end 15 of the outer cap 12 for effecting rotation of the inner cap 14 in the unthreading direction. The drive surfaces on the outer cap 12 are movable from an ineffective position, in which they are spaced from the drive surfaces on the periphery of the inner cap, to an effective position, in which the surfaces are in driving engagement for unscrewing the closure 11. A deliberate, strong, compression and deflection of the radially outer and circumferential area of the resilient upper end 15 of the outer cap 12 is required to inter-engage the drive surfaces to effect turning the inner cap 14 in the unthreading direction by the turning of the outer cap 12.

Figure 3:
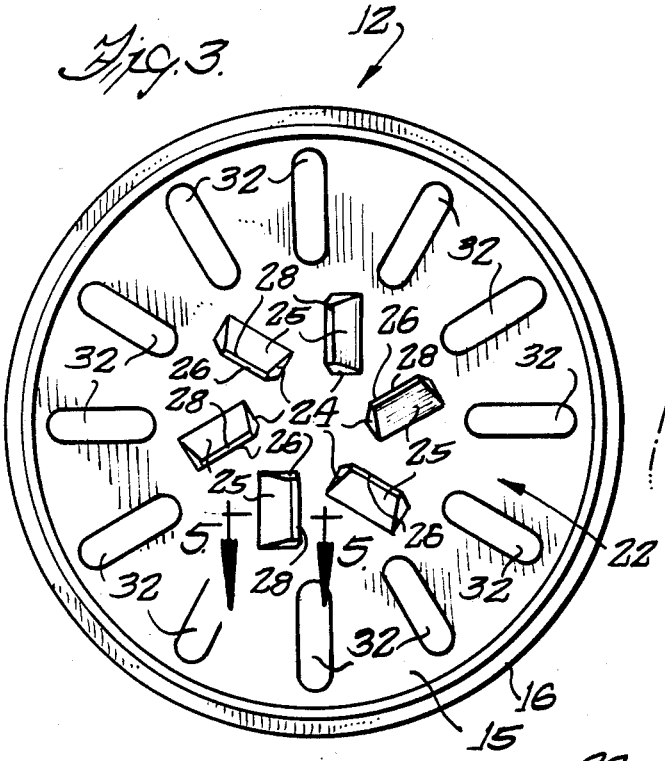
FIG. 3 is a plan view of the interior of the outer cap.
Figure 5:
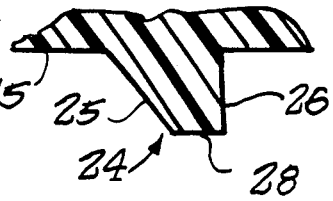
FIG. 5 is a cross-sectional elevation taken substantially along line 5—5 of FIG. 3 showing a unidirectional drive lug.
Figure 2:
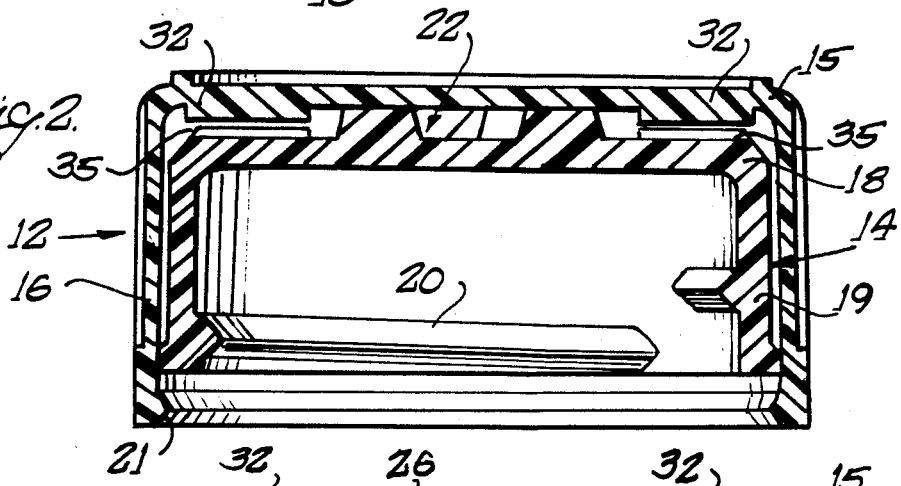
FIG. 2 is a cross-sectional elevation taken substantially along line 2—2 of FIG. 1 showing the inner cap and outer cap in nested relation.
Figure 4:
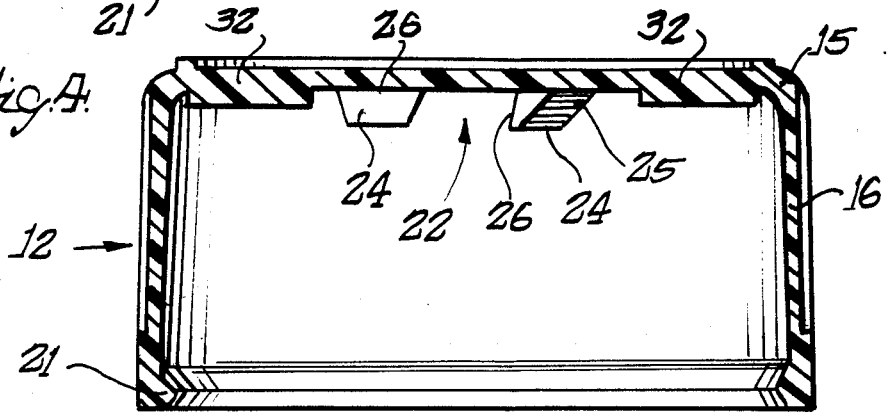
FIG. 4 is a cross-sectional elevation of the outer cap.

More specifically, the outer cap 12 is formed with a plurality of integral, downwardly-projecting segments or bars 32 (best seen in FIGS. 3 and 4) radially arranged adjacent the outer peripheral portion of the outer cap and on the inner surface of the upper end 15. The peripheral bars 32 extend downwardly from the upper end 15 of the outer cap 12 a distance less than that of the vertical drive surface 26 of the drive lugs 24. Consequently, absent downward deformation of the outer circumferential periphery of the upper end 15, the peripheral bars 32 are free from contact with the upper end 18 of the inner cap 14. The inner cap 14 is formed with a plurality of triangularly-shaped segments 34 arranged adjacent the peripheral portion of the upper end 18 thereof, such segments 34 extending upwardly a distance less than that of the drive surfaces 31 of the drive lugs 29 so as to be normally spaced from the upper end 15 of the outer cap 12 by means of the lugs 24, 29 (as seen in FIG. 2). Adjacent segments 34 are spaced to receive the peripheral bars 32 within the slots 35 formed thereby. By deforming or pressing the peripheral edge of the outer cap 12 downwardly, engagement between the peripheral bars 32 and triangularly-shaped segments 34 is effected, thus permitting rotation of the inner cap 14 upon rotation of the outer cap 12. Thus, to remove the closure a person must depress the rim of the container as with the palm of the hand and simultaneously turn the depressed outer cap to unscrew the inner cap. Such manipulation is beyond a young child and is termed child-safe.

Briefly reviewing the operation of the above-described embodiment of the inventive safety closure 10, the closure 10 is initially positioned in overlying relation to the container 11 by automatic capping equipment. By rotating the outer cap in the clockwise direction, the drive faces 26 of the lugs 24 on the outer cap 12 may be brought into face-to-face contact with the drive faces 31 on the lugs 29 of the inner cap 14 to effect a clockwise rotation of the inner cap 14 in unison with the outer cap 12, and thus thread the inner cap 14 downwardly onto the container 11. After closure of the container 11, reverse rotation of the outer cap 12, absent deformation of the peripheral area of the outer edge thereof, is ineffective to remove the inner cap 14 from the container 11 due to the overriding of the inclined ramp surfaces 25 and 30 of the driving lugs 24 and 29 of the unidirectional drive means 22.

To remove the safety closure 10 from the container 11, the peripheral portion of the resilient upper end 15 of the outer cap 12 is compressed downwardly usually by the inverted palm of the hand and rotated to inter-engage the bars 32 on the outer cap 12 with the segments 34 on the inner cap 14. After such inter-engagement, this continued depression with a simultaneous rotation of the outer cap 12 in a counterclockwise direction effects removal of the inner cap 14 from the threaded container 11.

Preferably, the resiliency of the upper end 15 of the outer cap 12 is selected so that the outer edge of the outer cap 12 cannot be manually compressed inwardly by a young child a sufficient distance to effect such inter-engagement between the peripheral bars 32 and the Vee-shaped segments 34, and a child will not also simultaneously turn the depressed outer closure as is required to open the closure 10. Additionally, the critical diameter requirements of the interlocking elements on the skirts 16, 19 of the inner and outer caps 12 and 14 have been eliminated due to all the elements required for effecting the on-off movement of the closure 10 being on the respective upper ends 15, 18 of the caps 12, 14.

Having thus described a preferred embodiment of the present invention, it will be understood that changes and modifications may be made therein without departing from the scope of the invention as set forth in the following claims.

What is claimed is:

1. A safety closure for a container comprising:

an inner cap having a rigid, non-deformable, planar upper end and a generally cylindrical skirt with a smooth outer surface, the inner surface of the skirt being adapted to be threadably secured on the container for effecting the closure thereof;

an outer cap coaxially aligned with and generally overlapping the inner cap, the outer cap having a resilient, planar upper end and a generally cylindrical skirt with a smooth inner surface;

inter-engageable unidirectional drive means disposed on the inner side of the upper end of the outer cap and on the outer side of the upper end of the inner cap and encircling a central planar portion of the inner and outer caps about the axis of the closure to drive the inner cap in a closing direction upon depression and simultaneous turning movement of the central portion of the end of the outer cap;

selectively engageable drive means disposed at the peripheries of the inner side of the upper end of the outer cap and the outer side of the upper end of the inner cap and extending radially outwardly to the skirts of the caps, such selectively engageable drive means being engageable only upon deformation of the peripheral region of the resilient upper end of the outer cap and operable upon a simultaneous turning movement of the outer cap in the opening direction to unthread the inner cap from the container, said inter-engageable drive means engaging a planar surface of the opposing cap and spacing said central planar portions of said end walls of said caps from one another.

2. A safety closure in accordance with claim 1 in which the inter-engageable unidirectional drive means comprises a series of upwardly projecting lugs on the upper end of the inner cap and a plurality of downwardly projecting segments to be engaged in driving relationship to apply the closure to a container with depression of the outer cap relative to the inner cap by automatic capping equipment to thread the closure onto the container.

3. A closure in accordance with claim 2 in which the selectively engageable drive means comprises a plurality of elongated radially projecting bars spaced circumferentially and projecting from the cap end wall and a plurality of elongated slots formed in the top wall of the other cap, said bars being positioned into said slots with downward deflection of the peripheral region of the outer cap.

4. A closure in accordance with claim 3 in which said slots are formed in the top end wall of the inner cap and form triangular-shaped projections on the upper peripheral portion of the inner cap.

5. A closure in accordance with claim 3 in which an outer circular array of slots surrounds an inner circular array of upwardly projecting lugs on the inner cap.

6. A closure in accordance with claim 5 in which the elongated bars depend from the top end wall of the outer cap in a circular array about the peripheral portion of the outer cap's top end wall, and in which the plurality of downwardly projecting lugs are arranged in a circular array within the array of elongated bars.

7. A safety closure for a container comprising:

an inner cap having a rigid, non-deformable, planar upper end and a generally cylindrical skirt with a smooth outer surface extending downwardly from the periphery of the outer edge of the upper end, the inner cap being adapted to be threadably secured on the container for effectuating the closure thereof and having a series of upwardly projecting lugs arranged about a central planar portion of the upper end of the inner cap and a series of upwardly projecting segments radially arranged about the periphery of the upper end and extending outwardly to the skirt, each lug having an inclined ramp surface and a substantially vertically extending drive face that extends upwardly a distance greater than that of the peripheral segments;

an outer cap coaxially aligned with and generally overlapping the inner cap, the outer cap having a planar resilient upper end and generally cylindrical skirt with a smooth inner surface extending downwardly from the periphery of the outer edge of the upper end, the inside of the upper end having a series of downwardly projecting lugs arranged about a central planar portion of the upper end of the outer cap and radially aligned with the lugs projecting upwardly from the inner cap, and a series of downwardly projecting segments radially arranged about the periphery of the upper end extending outwardly to the skirt of the outer cap and radially aligned with the segments projecting upwardly from the inner cap, said lugs on said inner cap engaging the inside of the planar upper end of the outer cap and said lugs on said outer cap engaging the planar upper end of the inner cap at locations encircling a central planar portion of the other cap and spacing the respective caps from each other, each lug having an inclined ramp surface and a substantially vertically extending drive face that extends downwardly a distance greater than that of the peripheral segments, the drive faces of the lugs on the inner and outer caps being movable into face-to-face relation so that the drive faces of the lugs on the outer cap abut the drive faces of the lugs on the inner cap when the outer cap is rotated in the closure direction to rotate the inner and outer caps in unison in the closure direction and the inclined ramp surfaces of the lugs on the outer cap slide over the inclined ramp surfaces of the lugs on the inner cap when the outer cap is rotated in an unlocking direction, the safety closure being removable upon deformation of the periphery of the outer cap so that the peripheral segments on the outer cap engage the peripheral segments on the inner cap so that the inner and outer caps may rotate in unison in the unlocking direction.

* * * * *